US012669039B2

(12) United States Patent
Shearer et al.

(10) Patent No.: US 12,669,039 B2
(45) Date of Patent: Jun. 30, 2026

(54) METHODS AND SYSTEMS FOR AN ADDRESSABLE SWITCH IN A CARTRIDGE THAT CREATES A SAFE BARRIER BETWEEN SURFACE EQUIPMENT AND EXPLOSIVE DEVICE

(71) Applicant: GREENWELL ENGINEERING LLC, Weatherford, TX (US)

(72) Inventors: Gary Shearer, Flint, TX (US); Chris Reed, Canton, TX (US)

(73) Assignee: Greenwell Engineering, Inc., Weatherford, TX (US)

( * ) Notice: Subject to any disclaimer, the term of this patent is extended or adjusted under 35 U.S.C. 154(b) by 0 days.

(21) Appl. No.: 18/736,788

(22) Filed: Jun. 7, 2024

(65) Prior Publication Data

US 2025/0012174 A1 Jan. 9, 2025

Related U.S. Application Data

(60) Provisional application No. 63/472,023, filed on Jun. 9, 2023.

(51) Int. Cl.
*E21B 43/1185* (2006.01)

(52) U.S. Cl.
CPC ..... *E21B 43/1185* (2013.01)

(58) Field of Classification Search
CPC ..... E21B 43/1185
See application file for complete search history.

(56) References Cited

U.S. PATENT DOCUMENTS

| | | | | |
|---|---|---|---|---|
| 10,914,145 | B2 | 2/2021 | Sullivan | |
| 11,255,162 | B2 | 2/2022 | Sullivan | |
| 11,255,650 | B2 | 2/2022 | Sullivan | |
| 11,268,376 | B1 * | 3/2022 | Jackson | E21B 43/116 |
| 11,293,737 | B2 | 4/2022 | Sullivan | |
| 11,402,190 | B2 | 8/2022 | Sullivan | |
| 12,140,022 | B1 * | 11/2024 | Jackson | E21B 47/12 |
| 2008/0149338 | A1 * | 6/2008 | Goodman | E21B 43/117 166/299 |
| 2008/0202325 | A1 * | 8/2008 | Bertoja | E21B 43/1185 89/1.151 |
| 2015/0000509 | A1 * | 1/2015 | Current | E21B 43/11 89/1.15 |
| 2015/0107090 | A1 * | 4/2015 | Keppler | E21B 43/1185 29/610.1 |
| 2020/0225014 | A1 * | 7/2020 | Maxted | E21B 43/1185 |
| 2020/0300593 | A1 * | 9/2020 | Sullivan | E21B 43/1185 |
| 2020/0332630 | A1 * | 10/2020 | Davis | E21B 23/04 |
| 2021/0055092 | A1 * | 2/2021 | Sullivan | F42D 1/05 |
| 2021/0207934 | A1 * | 7/2021 | Sullivan | E21B 43/1185 |
| 2022/0251930 | A1 * | 8/2022 | Koon | E21B 43/119 |
| 2024/0084678 | A1 * | 3/2024 | Wroblicky | E21B 43/1185 |

* cited by examiner

*Primary Examiner* — Jonathan C Weber

(57) ABSTRACT

Safe addressable firing controls positioned within a reusable housing that only allows voltage and current from the shooting panel to reach the explosive device by addressing the switch to open allowing electricity to pass through it and setting off the chain reaction during detonation, wherein the safe addressable firing controls positioned within a cartridge that creates a safety barrier between the surface equipment and a downhole tool, such as an explosive device.

12 Claims, 6 Drawing Sheets

PRIOR ART

METHODS AND SYSTEMS FOR AN ADDRESSABLE SWITCH IN A CARTRIDGE THAT CREATES A SAFE BARRIER BETWEEN SURFACE EQUIPMENT AND EXPLOSIVE DEVICE

BACKGROUND INFORMATION

Field of the Disclosure

Examples of the present disclosure relate to systems and methods associated with safe addressable firing controls positioned within a cartridge that creates a safety barrier between the surface equipment and a downhole tool, such as an explosive device. More specifically, embodiments are directed towards safe addressable firing controls positioned within a reusable housing that only allows voltage and current from the shooting panel to reach the explosive device by addressing the switch to open allowing electricity to pass through it setting off the chain reaction during detonation, wherein the cartridge is wired to only be able to shoot a single explosive device with no external wiring requirements.

Background

In the oil and gas industry, the term wireline broadly defines industry-specific methods, processes, and technologies that lower cables and wires into a wellbore. The wirelines are strong, thin lengths of wire or braided cable mounted on a power reel. Wireline activities are vital for oilfield operations and are essential to oil and gas exploration.

Traditionally, in single explosive device tool strings, explosive devices were directly wired with minimal electrical current protection to prevent inadvertent detonation. This approach heavily relied on the competency of the wireline engineer/operator to follow strict safety protocols and proper wiring techniques, ensuring safe and efficient operations. Improper wiring could lead to misfires or misruns if the detonator became detached from the tool string wiring during the trip into the wellbore. Additionally, stray radio frequencies at the well location or stray voltage from the wireline truck could produce sufficient power to initiate a resistorized detonator inadvertently.

In multiple explosive tool strings, mechanical switches were used to change the polarity of the detonation wiring circuit, allowing for the individual detonation of explosive devices. However, these had to be shot in series, with no means to skip over a device or provide any diagnostics of the wiring integrity.

Addressable switches were introduced to address these issues and provide a safer, more reliable solution. Addressable switches were initially designed to alleviate problems in original plug and perf systems used in horizontal completions, addressable switches later evolved to serve as safety devices in environments with stray voltage from sources such as two-way radios, cell phones, and communication towers. These switches create safe barriers between perforating panels and explosive devices, allowing for the use of conventional detonators and ignitors. They selectively restrict voltage and current from traveling through the wireline to the explosive device until activated by software commands.

To activate a conventional addressable switch, the switch is addressed through the operating software, sending a command down the wireline from the surface using a computer. This command opens the switch, allowing voltage and current to flow from a perforating panel on the surface, thereby setting off the detonator or ignitor in an explosive device. These conventional addressable switches are typically used in perforating gun systems, where they are exposed to extreme pressures and temperatures during detonation and are subsequently destroyed upon successful operation. The conventional addressable switches are coupled with a surface device that interfaces with the switch through the wireline, controlling the switch to open or close the detonation circuit and allowing power from another surface-mounted device, known as a shooting panel, to apply power to the detonator, initiating the explosive train.

Today, almost all perf & plug operations utilize addressable switch systems to complete horizontal oilfield wells, allowing for an infinite number of guns and one plug per stage in a horizontal completion. However, conventional addressable switches are often too large to fit inside various diameter wireline tools and are destroyed after the perforating gun fires.

Conventional or Day work in the oil and gas industry consists of vertical wellbore completion/recompletion, well abandonment, pipe recovery, packer or plug setting services, and occasionally some horizontal work. Conventional wireline work usually involves using only one explosive chain at a time without a safe barrier between the perforating panel and the explosive device. Wireline employees must follow the EBBA (Electric Before Ballistic Arming) rule when connecting explosive devices to the wireline. Although some safe detonators and ignitors are available for hazardous environments with stray voltage, they are much more expensive than conventional explosive devices, harder to find, and more difficult to operate. While addressable switches used in horizontal completions have occasionally been adapted for conventional work, the variety of device sizes and connections used in conventional work often renders the addressable switch ineffective.

Accordingly, needs exist for systems and methods associated with an addressable switch for an explosive device positioned within a cartridge in a reusable housing that creates a safe barrier.

SUMMARY

Embodiments disclosed herein describe systems and methods for safe addressable firing controls positioned within a reusable housing that only allow voltage and current from the shooting panel to reach a downhole tool or explosive device by addressing the switch to open allowing electricity to pass through the addressable setting off the chain reaction during detonation or activating the downhole tool. Specific embodiments may be directed towards systems that utilize a single addressable switch with a single explosive device, wherein the ground side of the detonator may be integrated into the ground of the circuit and the addressable switch.

Embodiments will also confirm to APRI RP67 and other required safety standards, wherein embodiments utilize addressable switches as electric safety barriers for any downhole applications utilizing electricity. Specifically, embodiments are directed towards a device configured to be installed above an explosive deployed on an electric wireline unit. For example, embodiments may be directed toward a Versafire control cartridge that is small enough to be inserted into conventional wireline tool strings and/or plug & perf systems. Embodiments may include an explosive device, detonator or ignitor, wireline, housing, and cartridge.

The explosive device, such as a perforating gun, may include a set of explosive charges that are run down to a desired depth, and then detonated. In alternative embodiments, the explosive device may be jet cutters, string shot, tubing punchers, etc. The explosive device may be configured to receive a signal from an up hole detonator to ignite the explosive charges. Responsive to the explosive charges igniting, heat and debris may be generated within an annulus between the string and the cased hole.

The detonator may be positioned between the housing and the explosive device, and the detonator may be configured to receive a signal from the cartridge to ignite the explosives within the explosive device. In specific embodiments, the wireline may be configured to transmit an electrical signal to the cartridge, which can be relayed to the detonator or ignitor. In embodiments, one side of the detonator may always be grounded.

Wireline, or electric line, maybe a multi-conductor, single conductor, or cable configured to provide a pathway for electric communication between the surface equipment and the cartridge. In embodiments, the wireline may be run from the surface to the housing.

The housing may be a metallic housing that is configured to protect elements positioned within the housing. In embodiments, the housing may be a machined housing that creates a safe barrier between a surface perforating panel and the downhole tool, such as the explosive device. The housing may have an input configured to receive a signal from the wireline and an output that is configured to transmit voltage and current to the detonator or other downhole tool when the addressable switch is activated. In embodiments, the outer surface of the housing may be configured to receive forces caused by the explosive detonation, which may protect embedded components within the cartridge. In embodiments, the housing may be a dedicated housing that is configured to protect the addressable switch positioned within the cartridge from a blast.

The cartridge may be a reusable, secondary housing that is configured to be embedded within the housing. The cartridge may be built small enough to be inserted into a housing within any oil and gas well. The cartridge may be embedded within the housing to protect the elements of the cartridge from the downhole environment, and make an electrical connection between the wireline and the detonator. This protection of positioning the cartridge within a dedicated housing may allow the cartridge to be a reusable cartridge that can be utilized a plurality of times within different explosive devices. The cartridge may include an input, addressable switch, output, and external grounds. In embodiments, the dedicated housing positioned above a detonator is configured to house a single reusable cartridge that protects a single addressable switch in a tool string, wherein the electrical signal must pass through multiple electrical bulkheads before reaching the detonator. This is different than conventional systems where the addressable switches are exposed to the blast of the explosive device.

The addressable switch may be a switch that can be turned on or off via the surface computing device. When the addressable switch is turned off, current and voltage may not pass through the cartridge or housing to the downhole tool or explosive device. This allows the cartridge with the addressable switch to be deployed for use in conventional and day work, allowing for completely safe operations. Responsive to receiving commands from the surface computing device addressing the switch to open, the addressable switch may open allowing electricity to pass through the addressable switch to activate the downhole tool, such as a chain reaction during detonation of a explosive device.

Embodiments of the housing may be designed to be used in conventional subs used in the wireline industry to make up with other downhole tools or explosive devices. Furthermore, the housing and cartridge would be reusable housing that could be used over and over unlike plug & perf switches that are destroyed during detonation in plug & perf operations.

Further embodiments would allow for multi-function of explosive devices by placing more than one housing with a cartridge and addressable switch in a tool string. This would allow embodiments to run addressable switches as a safe barrier in all convention and day work applications.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions, or rearrangements may be made within the scope of the invention, and the invention includes all such substitutions, modifications, additions, or rearrangements.

BRIEF DESCRIPTION OF THE DRAWINGS

Non-limiting and non-exhaustive embodiments of the present invention are described concerning the following figures, wherein reference numerals refer to like parts throughout the various views unless otherwise specified.

Figure 1:
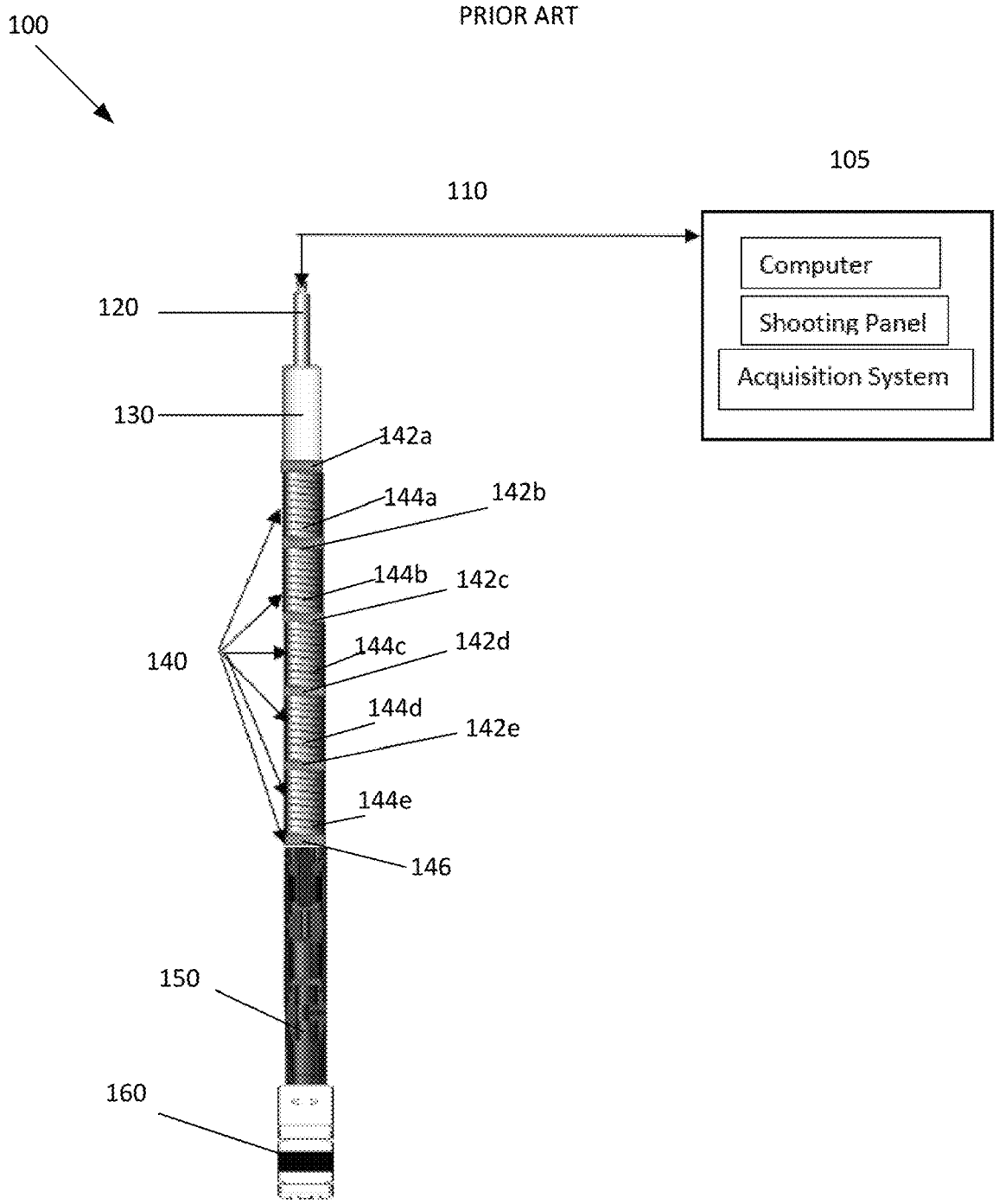
FIG. 1 depicts a conventional addressable plug & perf system used for pump down, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted to facilitate a less obstructed view of these various embodiments of the present disclosure.

DETAILED DESCRIPTION

In the following description, numerous specific details are outlined in order to provide a thorough understanding of the present invention. It will be apparent, however, to one having ordinary skill in the art that the specific detail need not be employed to practice the present invention. In other instances, well-known materials or methods have not been described in detail to avoid obscuring the present invention.

FIG. 1 depicts a conventional addressable plug & perf system 100 used for pump down, according to an embodiment. System 100 may include surface computing system 105, wireline 110, cable head 120, collar locator 130, downhole systems 140, setting sleeve 150, and frac plug 160.

Computing system 105 may be positioned at the surface of the wellbore, and configured to transmit downhole electrical signals to communicate with downhole addressable switches, such as perforating gun systems 140 and/or setting tool 150. Computing system 105 may include a computer, shooting panel, and acquisition system, and may be configured to transmit an addressable signal to perforating gun systems to activate an identified addressable switch. Responsive to activating the addressable switch, the switch may open allowing voltage and current to run through the addressable switch.

Wireline 110, or electric line, may be a multi-conductor, single conductor, or cable that is configured to provide a pathway for electric communication between the surface equipment and the cartridge. In embodiments, wireline 110 may be run from the surface to the housing. Wireline 110 may be configured to relay commands from the surface computing device 105 addressing the switch to open.

Cable head 120 may be the uppermost portion of a tool string on any given type of wireline. Cable head 120 may be where the conductor wire is made into an electrical connection that can be connected to the rest of the tool string.

Collar locator 130 may be a device that is configured to confirm or correlate treatment depth using known reference points on the casing string. More specifically, collar locator 130 may be a passive logging tool that detects magnetic anomalies caused by the relatively high mass of the casing collar locator 130.

Downhole systems 140 may include a plurality of perforating guns, each having a corresponding addressable switch, and an addressable switch for frac plug 160. For example, a first addressable switch 146 corresponds to an ignitor in the setting tool and frac plug and a second addressable switch 142*e* may correspond first perforating gun. Conventionally, when computing system 105 transmits a command to a corresponding addressable switch 146, the addressable switch 142*a* through 142*e* remain closed and set off a chain reaction to first the explosives associated with a corresponding setting tool 146. This may end up damaging the first addressable switch 146, not allowing the first addressable switch 146 to be reused.

Figure 2:
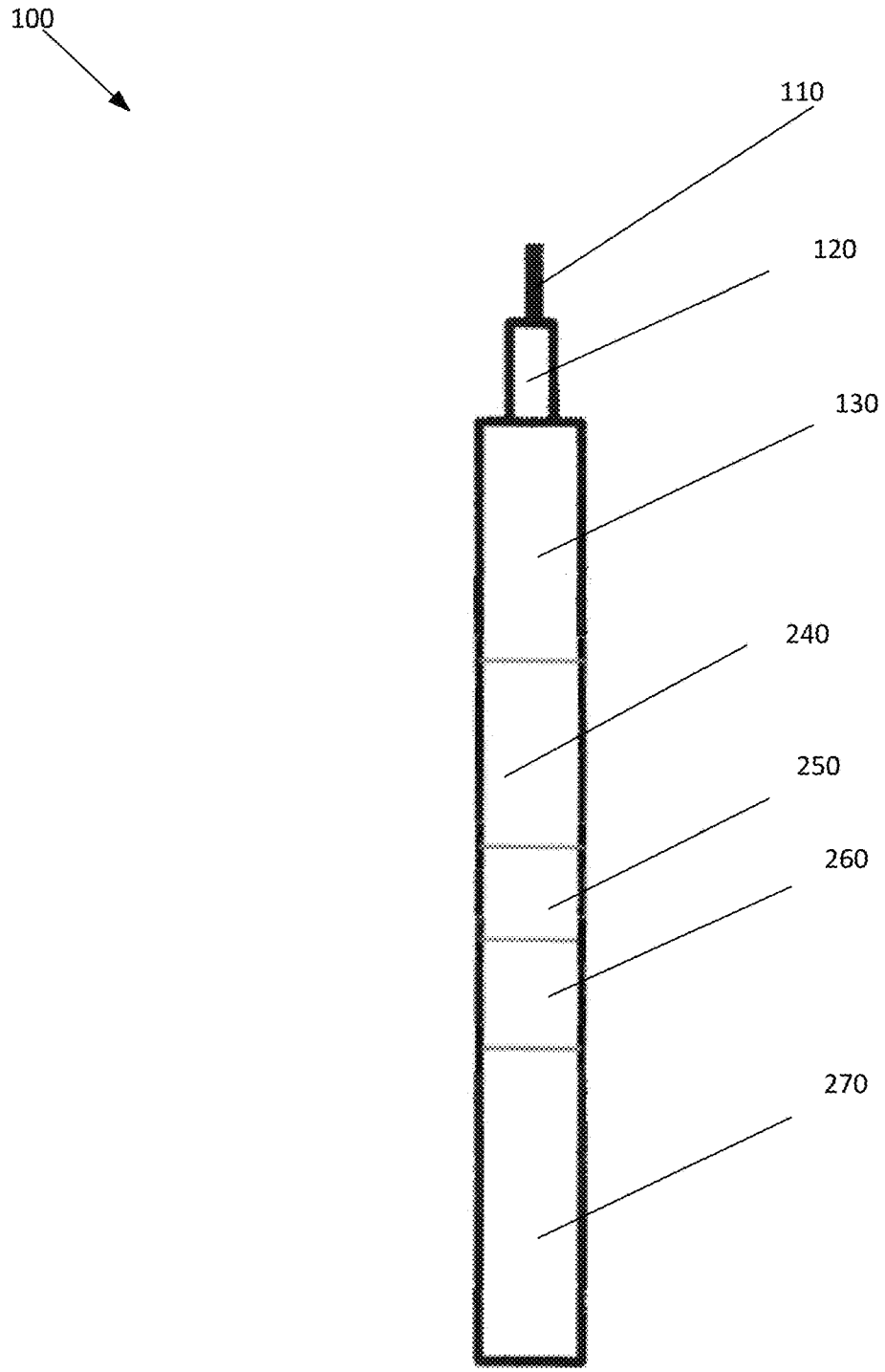
FIG. 2 depicts a system with an addressable switch in a cartridge that creates a safe barrier between a surface perforating panel and an explosive device, according to an embodiment.

FIG. 2 depicts a system with an addressable switch in a cartridge that creates a safe barrier between a surface perforating panel and explosive device, according to an embodiment. Elements depicted in FIG. 2 may be described above, and for the sake of brevity a further description of these elements may be omitted. System 100 may also include a weight bar 240, housing 250, detonator 260, and explosive device 270.

Weight bar 240 may be a device positioned between collar locator 230 and housing 250 that is configured to overcome the effects of wellhead pressure and friction at the surface seal where the wire enters the wellbore. In embodiments, weight bar 240 may include a solid steel stem, with internal cavities filled with alloys.

Housing 250 may be a metallic housing that is configured to protect elements positioned within housing 250, such as cartridge 320. Housing 250 may be a machined housing that creates a safe barrier between a surface perforating panel associated with computer system 105 and the downhole tool, such as the explosive device 270. Housing 250 may have an input configured to receive a signal from the wireline 110, and an output that is configured to transmit voltage and current to detonator 260 or another downhole tool when the addressable switch is activated. In embodiments, detonator 260 may be associated with any type of explosive device.

In embodiments, housing 250 may be positioned between weight bar 240 and detonator 260, which are positioned up hole from explosives 270. The outer surface of housing 250 may be configured to receive forces caused by the explosive igniting, which may protect embedded components within cartridge 320.

In embodiments, housing 250 may be coupled to weight bar 240 and/or detonator 260 via threads, wherein housing 250 may be a reusable housing that can be utilized multiple times. One skilled in the art may appreciate that a single wireline 200 may include multiple housings 250, wherein each housing 250 corresponds with a different downhole tool.

Detonator 260 is positioned between the housing 250 and the explosive device 270. Detonator 260 may be configured to receive a signal from the addressable switch positioned within cartridge 320 which allows it to ignite the explosives within the explosive device 270. In specific embodiments, the wireline 110 may be configured to transmit an electrical signal to the addressable switch, which can open to allow electricity to flow through the addressable switch from the perforating panel.

Explosive device 270 may be a device that is configured to provide holes within the casing, tubing, or liner of an oil well to connect it to the reservoir. In embodiments, explosive device 270 may be any type of explosive device. Explosive device 270 may include a set of explosive charges that are run down to a desired depth and then detonated. Explosive device 270 may be detonated from an up-hole detonator or ignitor 260 to ignite the explosive charges. Responsive to the explosive charges igniting, heat and debris may be generated within an annulus between the string and the cased hole.

Figure 3:
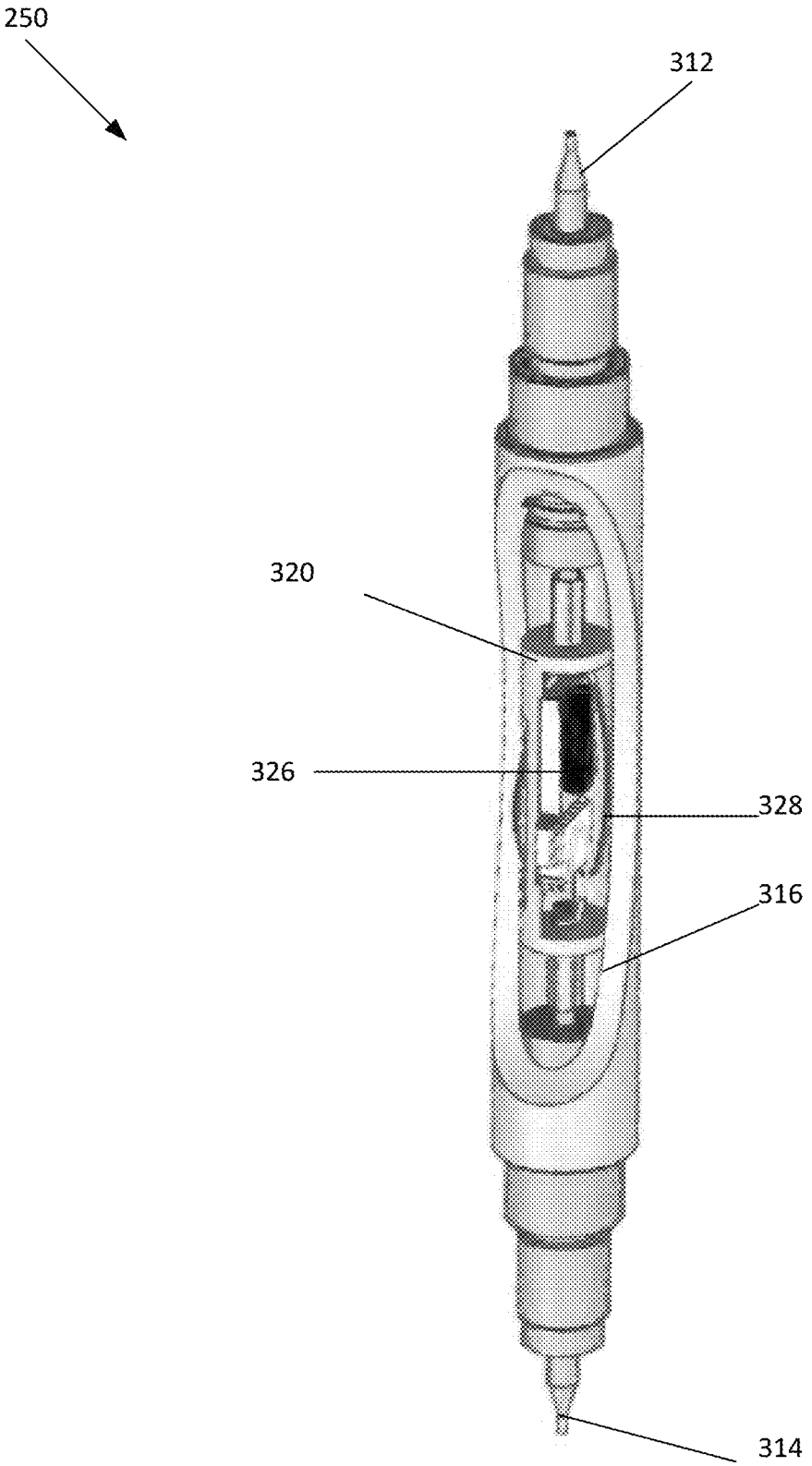
FIG. 3 depicts a housing for an addressable plug & perf system, according to an embodiment.

FIG. 3 depicts housing 250, according to an embodiment. Elements depicted in FIG. 3 may be described above, and for the sake of brevity, a further description of these elements may be omitted.

As depicted in FIG. 3, housing 250 may include a housing input 312, housing output 314, and internal chamber 316.

Housing input 312 may be directly coupled to the wireline 110 and be configured to receive an electrical signal. The electrical signal may include information associated with addressable switch 326 embedded within cartridge 320. The electrical signal may cause addressable switch 326 to become active, allowing current and voltage to flow through housing 250. Responsive to addressable switch 326 becoming activated and electricity flowing through addressable switch, a detonator 260 may set off a chain reaction to ignite a specific explosive device 270. Housing output 314 may be an output terminal configured to relay electricity to a downhole detonator 260 to ignite a specific explosive device 270.

Cartridge 320 may be a secondary housing that is configured to be embedded within internal chamber 316. In embodiments, cartridge 320 may have no external wiring requirements, wherein cartridge 320 and housing 250 form multiple electrical bulkheads for an electrical signal before the signal reaches the detonator 160. Cartridge 320 may be built small enough to be inserted into an electric safety barrier, such as housing 250, within any oil and gas well.

Cartridge 320 to be reusable, and utilized in subsequent downhole runs in different wells. Cartridge 320 may be embedded within the housing 250 to protect the elements of the cartridge 320 from the downhole environment, and selectively and safely make an electric connection between the wireline 110 and the detonator 160. Cartridge 320 may include addressable switch 326, and external grounds 328, wherein cartridge 320 may be wired to only shoot one explosive device. In embodiments, reusable housing 250 with the cartridge 320 is not placed in a sub that includes the detonator 160 or an explosive device.

Addressable switch 326 may be a switch that can be turned on or off via the surface computing device 105. When Addressable switch 326 is turned off, current and voltage may not pass through the cartridge 320 or housing 250 to the downhole tool or explosive device. This allows the cartridge 320 with the addressable switch 326 to be deployed for use in conventional and day work, allowing for completely safe operations. Responsive to receiving commands from the surface computing device 105 addressing addressable switch 326 to open, the addressable switch 326 may open allowing electricity to pass through the addressable switch 326 to activate the downhole tool, such as a chain reaction during detonation of a explosive device. External grounds 328 may be grounding wire on the outer diameter of the cartridge.

Figure 4:
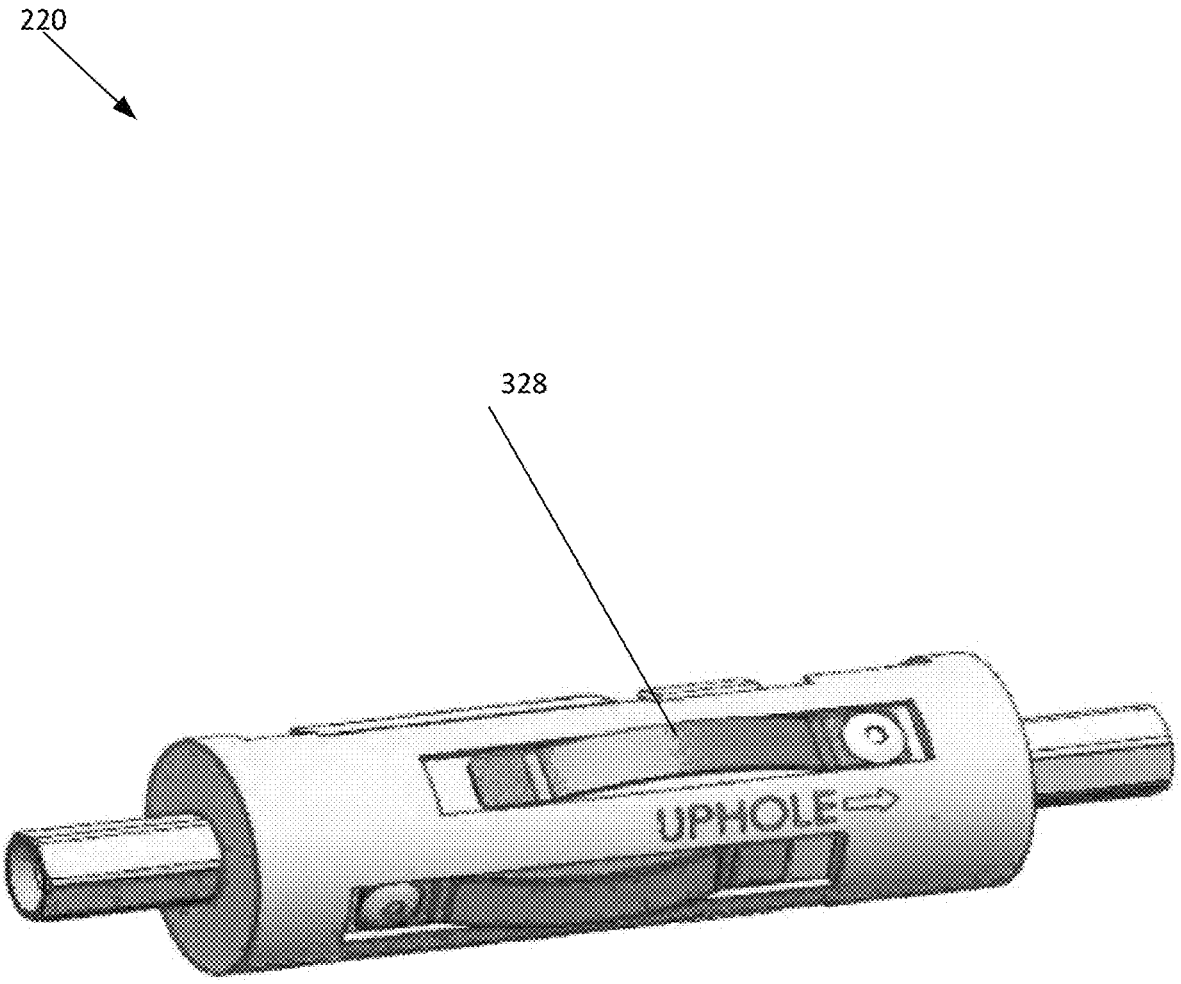
FIG. 4 depicts a cartridge for an addressable plug & perf system, according to an embodiment.

FIG. 4 depicts cartridge 320, according to an embodiment. Elements depicted in FIG. 4 may be described above, and for the sake of brevity, a further description of these elements may be omitted.

In embodiments, cartridge 320 may be configured to be inserted and coupled withing hollow chambers of different downhole tools. This may enable cartridge 320 to be utilized universally with a plurality of downhole tools in different environments. Furthermore, because cartridge 320 may be inserted into hollow chambers of different tools it may not be damaged during the explosions associated with a explosive device.

Figure 5:
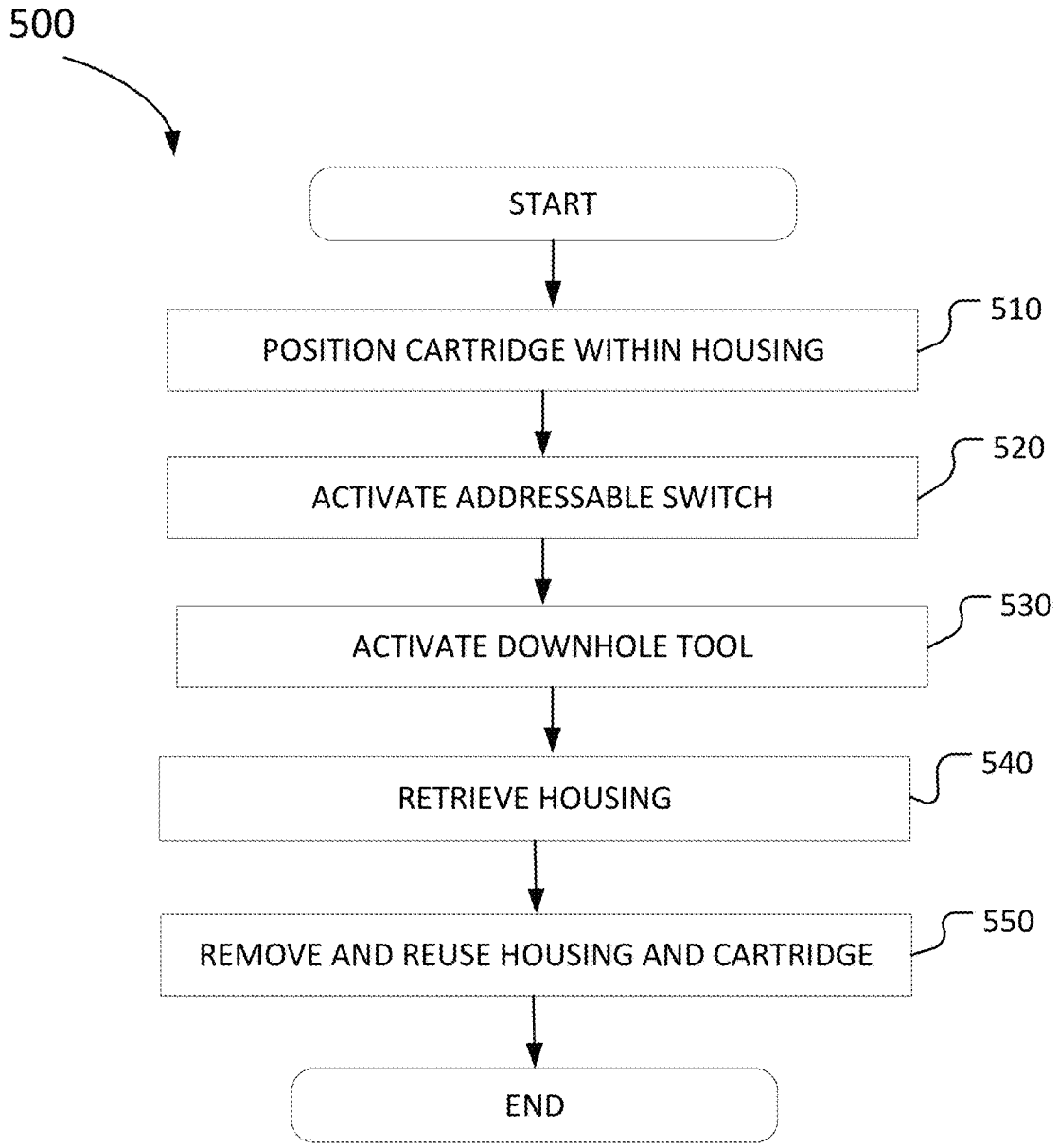
FIG. 5 depicts an operation sequence utilizing a cartridge positioned within a cartridge associated with a detonator, according to an embodiment.

FIG. 5 depicts an operation sequence utilizing a cartridge positioned within a cartridge associated with a detonator, according to an embodiment. The operational sequence presented below is intended to be illustrative. In some embodiments, operational sequence may be accomplished with one or more additional operations not described, and/or without one or more of the operations discussed. Additionally, the order in which the operations of the operational sequence are illustrated in FIG. 5 and described below is not intended to be limiting.

At operation 510, a cartridge with an addressable switch may be positioned within a housing on a wireline string. The housing may be positioned directly above a detonator or another tool on the tool string.

At operation 520, an electrical signal may be transmitted over the wireline to the cartridge to activate the addressable switch, allowing electricity to safely flow through the addressable switch.

At operation 530, the downhole tool associated with the addressable switch may receive electricity to be activated, and perform actions associated with the downhole tool. For example, the first detonator may ignite the explosives associated with the explosive device to perforate the casing. In embodiments, due to the cartridge being positioned within the housing, the cartridge will not be damaged by the explosion.

At operation 550, the housing and wireline string may be pulled out of the hole.

At operation 560, the housing and cartridge may be removed from the housing, and positioned in a new wireline string and utilized for subsequent downhole operations.

Figure 6:
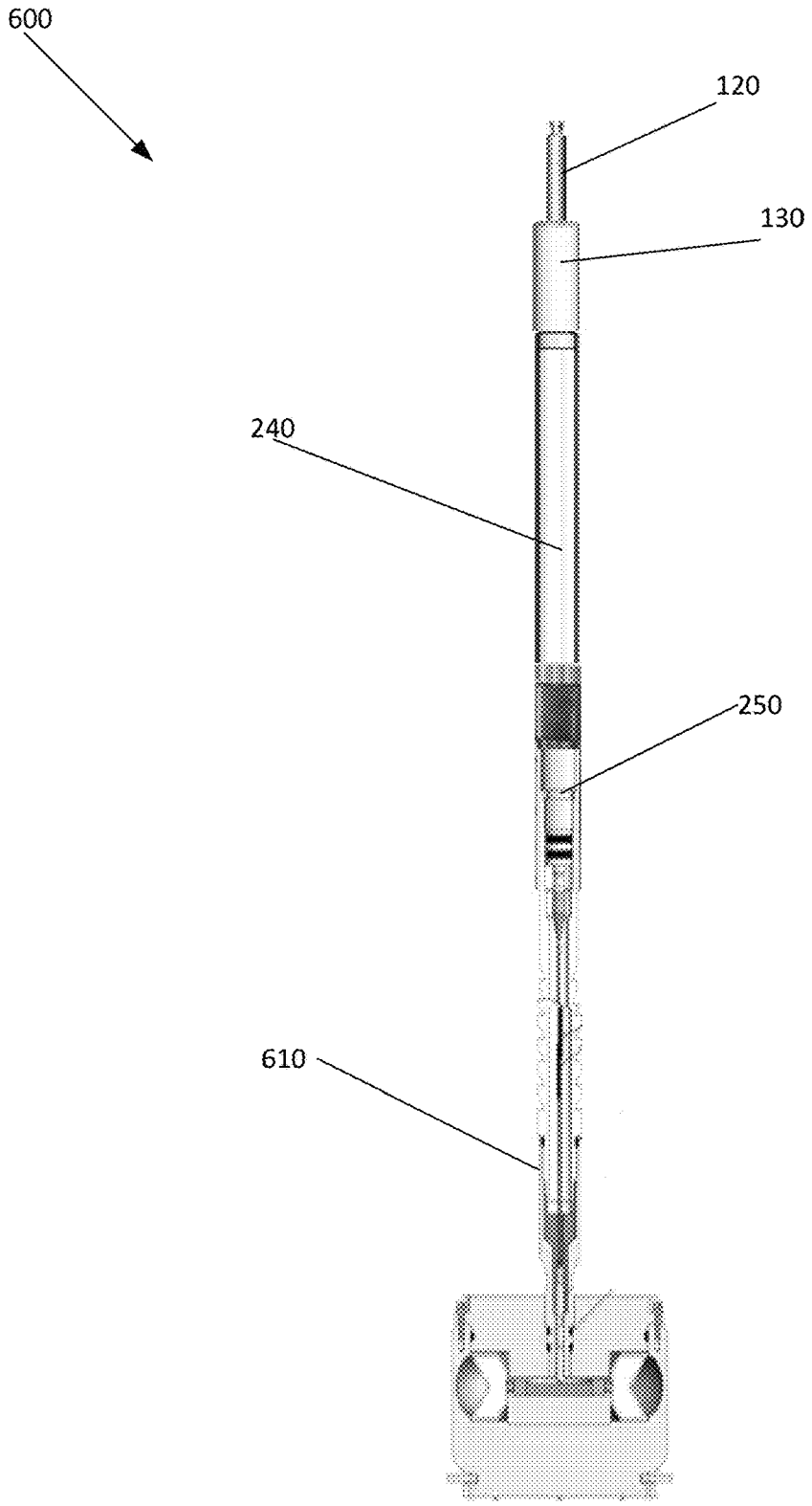
FIG. 6 depicts a system with an addressable switch in a cartridge that creates a safe barrier between a surface perforating panel and an explosive device, according to an embodiment.

FIG. 6 depicts a system with an addressable switch in a cartridge that creates a safe barrier between a surface equipment and an explosive device, according to an embodiment. Elements depicted in FIG. 6 may be described above, and for the sake of brevity, a further description of these elements may be omitted.

As depicted in FIG. 6, housing 250 may be coupled, physically and electronically, to downhole tool 610, wherein downhole tool 610 may be a casing cutter.

As described above, embodiments utilize a machined housing 250 machined housing with a purposeful addressable switch 326 in a cartridge 320, which creates a safe barrier between the surface equipment and downhole tool 610. Embodiments are designed with different sized housings 250 with a modified addressable switch 326 which allows the addressable switch 326 to be deployed for use in the conventional and day work environment allowing for complete safe operations with any desirable downhole tool 610.

Housing 250 with addressable switch 326 embedded within cartridge 320 can be placed in a tool string above any downhole tool 610, wherein housing 250 would only allow voltage and current from the shooting panel to reach the explosive device by the software in the computer by addressing the addressable switch 326 to open allowing electricity to pass through it setting off the chain reaction to activate downhole tool 610. The design of housing 250 would make it easy for conventional subs used in the wireline industry to make up with other tools or explosive devices. To this end, embodiments of housing, cartridge 320, and addressable switch 326 could be used over and over unlike plug & perf switches that are destroyed during detonation in plug & perf operations, and would conform to API RP67.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure, or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures, or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

The invention claimed is:

1. A system associated with an addressable switch for perforating devices, the system comprising:

a reusable housing that creates a safe barrier between surface equipment and an explosive device, a cartridge comprising a secondary housing positioned in an internal chamber within the reusable housing, wherein the secondary housing comprises a first electrical contact pin extending from one end of the secondary housing and a second electrical pin extending from an opposite end of the secondary housing, and wherein the cartridge is reusable and includes an addressable switch that is configured to be activated by signal transmission from the surface equipment via the electrical contact pins.

2. The system of claim 1, where the cartridge has no external wiring requirements.

3. The system of claim 1, where the cartridge is configured to only be able to shoot one explosive device.

4. The system of claim 1, wherein the cartridge includes external grounds on the outer diameter of the cartridge.

5. The system of claim 1, wherein the reusable housing is positioned between the distal end of a wireline and the detonator.

6. The system of claim 5, wherein the detonator is positioned uphole from the explosive device.

7. The system of claim 1, wherein an outer surface of the housing is configured to receive forces caused by igniting the explosive device.

8. The system of claim 1, wherein the reusable housing within the cartridge is configured to be pulled out of a hole after activating the explosive device, wherein the reusable housing within the cartridge is used in subsequent downhole operations on new wireline strings.

9. The system of claim 1, wherein the reusable cartridge is configured to only allow the voltage and the current to the detonator when the addressable switch is opened via the surface equipment.

10. The system of claim 9, wherein the reusable housing does not allow the voltage or the current to pass through the detonator before the addressable switch is opened via the surface equipment.

11. The system of claim 1, wherein the reusable housing and the cartridge are not damaged when an explosive device associated with the detonator is activated.

12. The system of claim 1, wherein the reusable housing with the cartridge is not placed in a sub that includes the detonator or an explosive device.

* * * * *